US011118751B2

(12) United States Patent
Monestier et al.

(10) Patent No.: US 11,118,751 B2
(45) Date of Patent: Sep. 14, 2021

(54) LIGHTING DEVICE WITH TRANSPARENT STABILIZER ELEMENT

(71) Applicant: Lumileds LLC, San Jose, CA (US)

(72) Inventors: Florent Monestier, Aachen (DE); Benno Spinger, Aachen (DE); Ulrich Hechtfischer, Aachen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/828,335

(22) Filed: Mar. 24, 2020

(65) Prior Publication Data

US 2020/0309342 A1 Oct. 1, 2020

(30) Foreign Application Priority Data

Mar. 26, 2019 (EP) ..... 19165183
Jul. 18, 2019 (EP) ..... 19186927

(51) Int. Cl.
*F21S 45/47* (2018.01)
*F21S 41/24* (2018.01)
(Continued)

(52) U.S. Cl.
CPC ..... *F21S 45/47* (2018.01); *F21S 41/143* (2018.01); *F21S 41/153* (2018.01); *F21S 41/24* (2018.01); *F21S 41/285* (2018.01); *F21V 5/008* (2013.01)

(58) Field of Classification Search
CPC ..... F21S 41/143; F21S 41/24; F21S 45/47
See application file for complete search history.

(56) References Cited

U.S. PATENT DOCUMENTS 8,115,217 B2 * 2/2012 Duong ..... H01L 33/507 257/88
10,054,279 B2 * 8/2018 Kliebisch ..... F21S 41/663
(Continued)

FOREIGN PATENT DOCUMENTS

EP 1396753 A1 3/2004
EP 3376099 B1 9/2019
(Continued)

OTHER PUBLICATIONS

EP App. No. 19165183.5, "Extended EP Search Report," dated Aug. 7, 2019, 7 pages.
(Continued)

*Primary Examiner* — Leah Simone Macchiarolo

(57) ABSTRACT

The present disclosure relates to a lighting device comprising light-emitting elements such as light-emitting diodes arranged on a substrate. The object to provide a lighting device comprising multiple light-emitting elements and light guides, wherein the thermal sensitivity of the lighting device is reduced in a particularly simple manner, is solved in that the lighting device comprises: a lens with a light entry side and a light exit side; light guides, each light guide being arranged in optical contact to at least one of the light-emitting elements and being configured to guide light emitted by the at least one of the light-emitting elements towards the light entry side of the lens; and a transparent stabilizer element being arranged in mechanical contact to the light exit side of the lens, wherein the transparent stabilizer element is configured to define the shape of the light exit side of the lens at least in regions. The invention further refers to a method for producing a lighting device.

16 Claims, 6 Drawing Sheets

(51) Int. Cl.

| | |
|---|---|
| ***F21S 41/143*** | (2018.01) |
| ***F21S 41/153*** | (2018.01) |
| ***F21S 41/20*** | (2018.01) |
| ***F21V 5/00*** | (2018.01) |

(56) References Cited

U.S. PATENT DOCUMENTS

| | | | | |
|---|---|---|---|---|
| 2004/0041984 | A1* | 3/2004 | Tani | F21V 29/763 353/20 |
| 2014/0126214 | A1* | 5/2014 | Gebhard | F21V 23/006 362/294 |
| 2015/0124469 | A1 | 5/2015 | Krenn et al. | |
| 2016/0071896 | A1* | 3/2016 | Kawabata | H01L 27/14605 348/294 |
| 2016/0252226 | A1* | 9/2016 | Shih | F21S 43/243 362/511 |
| 2017/0219186 | A1* | 8/2017 | Enno | F21V 5/007 |
| 2018/0264994 | A1 | 9/2018 | Stoehr et al. | |
| 2019/0204528 | A1* | 7/2019 | Oshima | F21S 41/141 |
| 2019/0353320 | A1* | 11/2019 | Shikata | F21S 41/285 |
| 2020/0191356 | A1* | 6/2020 | Zozgornik | F21S 41/29 |

FOREIGN PATENT DOCUMENTS

| | | | |
|---|---|---|---|
| WO | 2018024349 | A1 | 2/2018 |
| WO | 2018065278 | A1 | 4/2018 |

OTHER PUBLICATIONS

EP App. No. 19186927.0, "Extended EP Search Report," dated Feb. 5, 2020, 8 pages.

From the EPO as the ISA, Notification of Transmittal of the International Search Report and the Written Opinion of the International Searching Authority, or the Declaration, PCT/EP2020/056338, dated Jun. 9, 2020, 14 pages.

* cited by examiner

LIGHTING DEVICE WITH TRANSPARENT STABILIZER ELEMENT

CROSS REFERENCE TO RELATED APPLICATIONS

This application claims priority to European Patent Application No. 19165183.5 filed on Mar. 26, 2019, and European Patent Application No. 19186927.0 filed on Jul. 18, 2019, both of which are incorporated herein by reference.

FIELD OF THE INVENTION

The present disclosure relates to a lighting device, comprising multiple light-emitting elements such as light-emitting diodes (LEDs) arranged on a substrate and light guides guiding light from the light-emitting elements towards a lens, in particular in the field of automotive lighting.

BACKGROUND OF THE INVENTION

Lighting devices comprising multiple light-emitting elements are used to provide a higher light output, and may further allow for a variation in beam shape and emitted intensity. For instance, adaptive headlights in automobiles may comprise a matrix arrangement of light-emitting elements, wherein sections of light-emitting elements may be addressed independently of each other. The illumination provided by the headlight may therefore be switched from low beam to high beam by addressing corresponding light-emitting elements in the lighting device.

The illumination provided by light-emitting elements such as LEDs may be improved by using light guides, which for instance may be configured as collimators for the LEDs, to improve the directionality of the emitted light and to minimize light losses in the lighting device. Light guides for an arrangement of light-emitting elements such as a matrix arrangement may be configured as a finger-shaped collimator, wherein for each light-emitting element a light guide is provided, forming a "finger" of the collimator. The light guides are specifically shaped for each LED and require a reliable positioning relative to the LED to ensure an effective collimation of light.

A challenge when using light-emitting elements, such as LEDs, for purposes requiring high intensities such as automotive headlights is the high heat load that is generated when operating the lighting device. The heat load leads to thermal stresses inside the lighting device, such that light guides may deform and may be displaced relative to the light-emitting elements.

This effect may become significant when an arrangement of relatively close-packed light-emitting elements is used, leading to an uneven thermal expansion of the finger-shaped collimator. With this, a gap between the light-emitting face of the light-emitting elements and the light guides may increase, which reduces the amount of light coupled into the light guides. Moreover, as the heat load is higher in the center than near the edges of the arrangement of light-emitting elements, a bulging effect of the finger-shaped collimator may occur, which misaligns the light guides relative to the light-emitting elements by tilting the fingers of the collimator. Hence, the effectivity of collimation by the light guides is reduced and the emitted light pattern becomes inhomogeneous.

Attempts have been made to reduce the effect of thermal sensitivity of lighting devices. WO 2018/065278 A1 refers to a lighting arrangement with a holder for an optical element that is arranged spaced apart from at least one LED. The holder has a structure designed to be able to achieve stable positioning of the optical element even in case of severe mismatch in a coefficient of thermal expansion.

EP 3 376 099 A1 relates to a lighting arrangement, wherein an optical sub-holder bridges a connecting sub-holder to hold an optical element in a desired position relative to an LED lighting element. The optical sub-holder comprises at least one stress release element such as at least one open slit.

SUMMARY OF THE INVENTION

It is an object of the present invention to provide a lighting device comprising multiple light-emitting elements and light guides, wherein the thermal sensitivity of the lighting device is reduced in a particularly simple manner. It is also an object of the invention to provide a cost-effective method for producing such a lighting device.

According to a first aspect of the present invention, a lighting device is provided, comprising: light-emitting elements arranged on a substrate; a lens with a light entry side and a light exit side; light guides, each light guide being arranged in optical contact to at least one of the light-emitting elements and being configured to guide light emitted by the at least one of the light-emitting elements towards the light entry side of the lens; and a transparent stabilizer element being arranged in mechanical contact to the light exit side of the lens, wherein the transparent stabilizer element is configured to define the shape of the light exit side of the lens at least in regions.

According to a second aspect of the present invention, a method for producing a lighting device is provided, the method comprising: arranging light-emitting elements on a substrate; providing light guides and a lens with a light entry side and a light exit side, wherein each light guide is arranged in optical contact to at least one of the light-emitting elements and is configured to guide light emitted by the at least one of the light-emitting elements towards the light entry side of the lens; arranging a transparent stabilizer element in mechanical contact to the light exit side of the lens such that the transparent stabilizer element defines the shape of the light exit side of the lens at least in regions. With the method according to the second aspect, in particular a lighting device according to the first aspect is produced.

Further, the use of the lighting device according to the first aspect in automotive lighting, in particular as an automotive headlight is disclosed as well as an automotive headlight comprising the lighting device according to the first aspect.

Exemplary embodiments of the various aspects of the invention may have one or more of the properties described below.

The light-emitting elements are arranged on a substrate. The substrate may in particular comprise a planar shape. The substrate may serve to fix the light-emitting elements mechanically and may provide an electrical connection for the light-emitting elements. In particular, the substrate may be configured as a printed circuit board. In some embodiments, the light-emitting elements may be based on semiconducting elements such as a p-n-junction, a diode, and/or a transistor. For instance, the light-emitting elements are configured as LEDs, e.g. in form of separate or combined LED dies. In particular, the light-emitting elements may have a substantially planar shape, wherein one of the main faces of the planar shape is configured as a light-emitting face.

The lens is configured to refract at least part of the light emitted by the light-emitting elements. In particular, the lens may cover an area encompassing the light-emitting faces of the light-emitting elements. The lens has a light entry side and a light exit side, which may be shaped according to the desired refraction of the emitted light. In an embodiment, the lens may comprise a planar shape, with the light entry side and the light exit side being substantially parallel to each other at least in sections.

Each light guide is arranged in optical contact to at least one of the light-emitting elements and to guide light emitted by the at least one of the light-emitting elements towards the light entry side of the lens. In particular, the light guides are configured as collimators. The guiding of light may be based on total internal reflection at sidewalls of the light guides. The sidewalls therefore may comprise a shape suitable for the collimation of light, in particular a shape that expands from the side of the light guide facing the light-emitting elements to the side facing the lens.

In an embodiment, the light guides and the lens are configured as an integral element. In particular, the light guides and/or the lens comprise or consist of transparent silicone.

According to the invention, a transparent stabilizer element is arranged in mechanical contact to the light exit side of the lens. The mechanical contact may be a direct contact and/or may be an indirect contact, wherein other means are disposed in between the lens and the transparent stabilizer element. The mechanical contact may be established at least in regions, in particular in a center region of the light exit side, or across the entire light exit side. As the transparent stabilizer element is configured to define the shape of the light exit side of the lens at least in regions, the transparent stabilizer element stabilizes the shape of the lens and the light guides when temperature changes and thermal gradients occur during operation of the lighting device. The thermal expansion of the lens and the light guides is effectively limited in the direction of the light exit side due to the transparent stabilizer element. It has been found that a bulging effect of the lens and the light guides occurs without a transparent stabilizer element, the bulging effect leading to a tilting of the light guides relative to the light-emitting elements and an inhomogeneous distribution of distances between the light guides and the light-emitting elements. This critical effect for thermal sensitivity may be reduced with the transparent stabilizer element and the thermal sensitivity of the lighting device is significantly improved.

As the thermal expansion of the lens and the light guides is effectively limited in the direction of the light exit side due to the transparent stabilizer element, the light guides will tend to expand in a direction leading away from the light exit side and towards the light-emitting elements. In an embodiment, a predefined gap is provided between the light-emitting faces of the light-emitting elements and the light guides, such that a mechanical contact between the light-emitting elements and the light guide is avoided also at higher temperatures.

Alternatively, the light guides may be arranged in mechanical contact to the light-emitting elements at least in regions. As the expansion of the lens and the light guides is then limited by the transparent stabilizer element and the light-emitting elements in a direction substantially parallel to the surface normal of the substrate, the light guides will tend to compensate the thermal stress by a lateral expansion. The shape and size of the light guide may be configured such that a bulging of the light guide is avoided in the temperature range occurring during operation of the lighting device.

A direct mechanical contact between the light guides and the light-emitting elements may be provided by contact elements, e.g. round or squared tips on the bottom face of the light guides, to transfer the contact stress on a non-sensitive area of the light-emitting elements and to maintain a gap in regions between light-emitting faces and the light guides. Similarly, a spacing element may be provided between the light-emitting faces and the light guides. For example, a protection coating may be provided on the light-emitting elements to protect the light-emitting elements from high heat loads. Further, a transparent spacer element such as a glass sheet and/or plastics sheet may be provided at a bottom face of the light guides, wherein a gap is formed between the transparent spacer element and the light-emitting elements.

According to another exemplary embodiment of the invention, the transparent stabilizer element comprises a planar shape. The transparent stabilizer element may therefore be provided in a particularly simple manner, e.g. from sheet material, and the lighting device obtains a compact shape. In particular, the light exit side of the lens also comprises a planar shape at least in sections to provide a reliable mechanical contact between lens and transparent stabilizer element.

The configuration of the lighting device may be further simplified in that the transparent stabilizer element comprises or consists of glass. Glass provides high mechanical and thermal stability, while having a high transmittance.

According to another exemplary embodiment of the invention, the lighting device further comprises a holder disposed on the substrate, wherein the holder is configured to hold the transparent stabilizer element relative to the light-emitting elements. In particular, the holder holds the transparent stabilizer element at least in a direction substantially perpendicular to a surface normal of the substrate. Hence, a distance between the transparent stabilizer element and the substrate, as well as a distance between the light-emitting elements and the light exit side of the lens is defined by the holder.

The holder may hold the transparent stabilizer element directly or indirectly by other means such as a frame element. The frame element may comprise an opening in the area of the light-emitting elements to reduce the amount of light that is blocked by the frame element. In particular, the transparent stabilizer element may be arranged such that the opening of the frame element is covered by the transparent stabilizer element. The frame element and the holder may comprise attaching means such as corresponding latching elements to establish a mechanical connection. The frame element may in particular comprise or consist of opaque material, e.g. of metal.

The holder may surround the light-emitting elements, the light guides and/or the lens and may therefore provide mechanical protection for the lighting device. According to another exemplary embodiment of the invention, the holder comprises a lens recess for accommodating the lens, such that the lens may at least be partially inserted into the holder. After insertion of the lens, the transparent stabilizer element may be arranged on the light exit side of the lens, and the frame element may be connected to the holder and may fix the transparent stabilizer element on the lens. According to an alternative embodiment, the transparent stabilizer element may be overmolded.

In an exemplary embodiment, a gap is provided at least in sections between the holder and the lens in the lens recess. With the gap, the lens may thermally expand in the direction of the holder without substantial deformation of the lens such as a bulging effect. In particular, a gap is provided both in a direction substantially parallel to the surface normal of the substrate and directions substantially perpendicular to the surface normal of the substrate.

According to another exemplary embodiment of the invention, the holder comprises at least one lateral alignment element configured to hold the lens relative to the light-emitting elements, in particular in a direction substantially perpendicular to a surface normal of the substrate. With the lateral alignment element, the positioning of the lens relative to the light-emitting elements may be controlled when temperature changes occur, even when a gap is provided between the lens and the holder in the lens recess. Hence, the thermal stability of the lighting device is improved further.

The at least one lateral alignment element may be positioned substantially in the center of at least one edge region of the holder. Therefore, a thermal expansion of the lens may occur in two opposing directions away from the center of the at least one edge region, such that a displacement of the lens relative to the holder is reduced. For instance, the holder and/or the lens may comprise a substantially rectangular shape, wherein at least one lateral alignment element is arranged in the center of at least one long side and/or short side of the rectangular shape. In particular, the displacement of the lens may be effectively reduced by disposing lateral alignment elements at the center of the long sides of the rectangular shape of the holder.

According to another exemplary embodiment of the invention, the lens comprises a stabilizer recess for accommodating the transparent stabilizer element. For example, the stabilizer recess may provide a form fit for the transparent stabilizer element. The transparent stabilizer element may therefore be reliably positioned on the light exit side of the lens in a particularly simple manner.

According to another exemplary embodiment of the invention, the transparent stabilizer element and/or the lens are overmolded with a transparent covering material. The transparent covering material may therefore provide a simple mechanical connection of the transparent stabilizer element to the lens, and/or an optional holder that is provided on the substrate. In particular, a frame element arranged on the holder may be omitted, as the transparent covering material may mechanically connect the holder to the transparent stabilizer element, therefore predefining a distance between substrate and transparent stabilizer element. Overmolding with a transparent covering material allows for a particularly simple production of the lighting device. The transparent covering material may also comprise protrusions, in particular dome-shaped protrusions. The protrusions may each correspond to a light guide and may cover a footprint area of each light guide to improve light output.

According to another exemplary embodiment of the invention, the transparent stabilizer element is embedded at least partially inside of the lens. For example, a suitable lens material such as transparent silicone may be molded around the transparent stabilizer element. In this way, by providing the transparent stabilizer element and the lens essentially as an integral component, a particularly stable mechanical connection between lens and transparent stabilizer element can be achieved. In addition, this embodiment may allow for a particularly simple and cost-effective production of the lighting device where first the stabilizer element may be provided which may then be overmolded to yield the lens.

As described above, the transparent stabilizer element may be in direct or indirect mechanical contact of the light exit side of the lens. According to an exemplary embodiment of the invention, the transparent stabilizer element is arranged in mechanical contact to the light exit side of the lens via a paste. The paste may reduce friction between the lens and the transparent stabilizer element such that differences in the coefficient of thermal expansion between the lens and the transparent stabilizer element may be compensated, as a relative movement at the interface between lens and transparent stabilizer element is made possible by the paste. In particular, the mechanical contact is made via an optical index matching paste, such that an undesired reflection of light at the interface of lens and the transparent stabilizer element is reduced.

According to another exemplary embodiment of the invention, the light-emitting elements are arranged in a matrix on the substrate. The matrix may be regular or irregular. For instance, the light-emitting elements may be arranged in a 5×6 matrix.

In particular, the light-emitting elements are provided in an arrangement suitable for use in automotive lighting, in particular for an automotive headlight. At least part of the light-emitting elements may be configured to be addressed independently, i.e. the amount of light-emitting elements that are active/passive and/or the illumination pattern may be varied with the inventive lighting device. The lighting device may in particular be configured for adaptive head lighting.

In the inventive method for producing a lighting device, one or more method steps may comprise a molding process. In particular, the method may comprise overmolding the transparent stabilizer element and/or the lens with a transparent covering material.

Further, the light guides and/or the lens may be provided by a molding process. In particular, the light guides and the lens may be configured as an integral element that may be produced by molding, for instance from transparent silicone. In addition or alternatively, the method may comprise overmolding the transparent stabilizer element to yield the lens with the transparent stabilizer element being embedded at least partially inside of the molded lens.

According to an exemplary embodiment of the invention, a holder is disposed on the substrate, wherein the holder is configured to hold the transparent stabilizer element relative to the light-emitting elements. In particular, the holder is provided by a molding process. The molding process to provide the holder may be the same process step as the molding process to provide the light guides and/or the lens.

In an exemplary embodiment, the method comprises two molding steps. The lens and/or light guides are provided by molding, for example as an integrated element. Optionally, a holder may be provided on the substrate by molding. The lens and the light guides are arranged on the substrate. The transparent stabilizer element is arranged on the light exit side of the lens. Then, the transparent stabilizer element and/or the lens, optionally together with the holder, are overmolded by a transparent covering material.

It is to be understood that the presentation of embodiments of the invention in this section is merely exemplary and non-limiting.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

BRIEF DESCRIPTION OF THE DRAWINGS

Examples of the invention will now be described in detail with reference to the accompanying drawings, in which.

DETAILED DESCRIPTION OF THE EMBODIMENTS

Figure 1A:
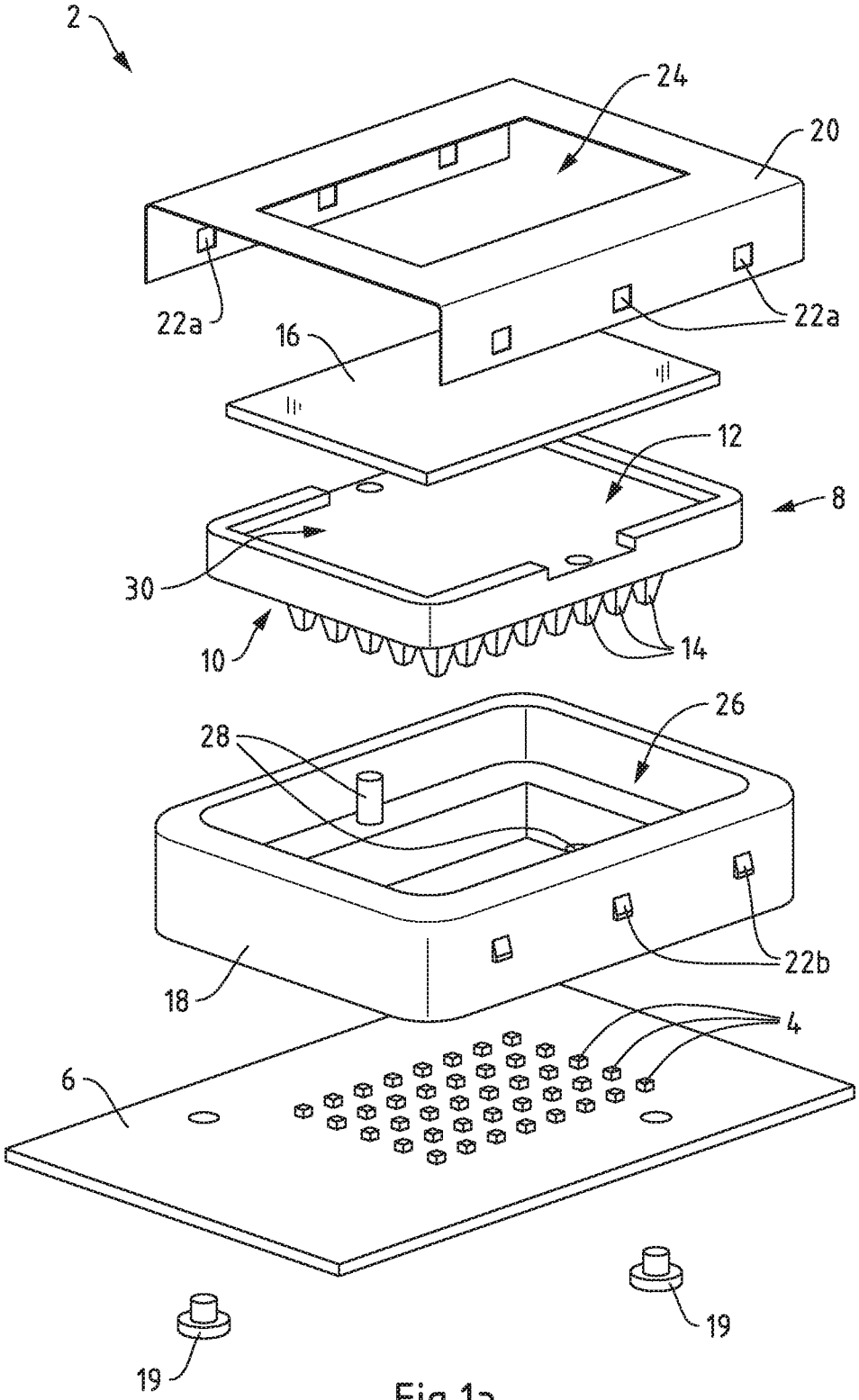
FIG. 1*a* schematically shows an embodiment of the lighting device according to the invention in an exploded view.
Figure 1B:
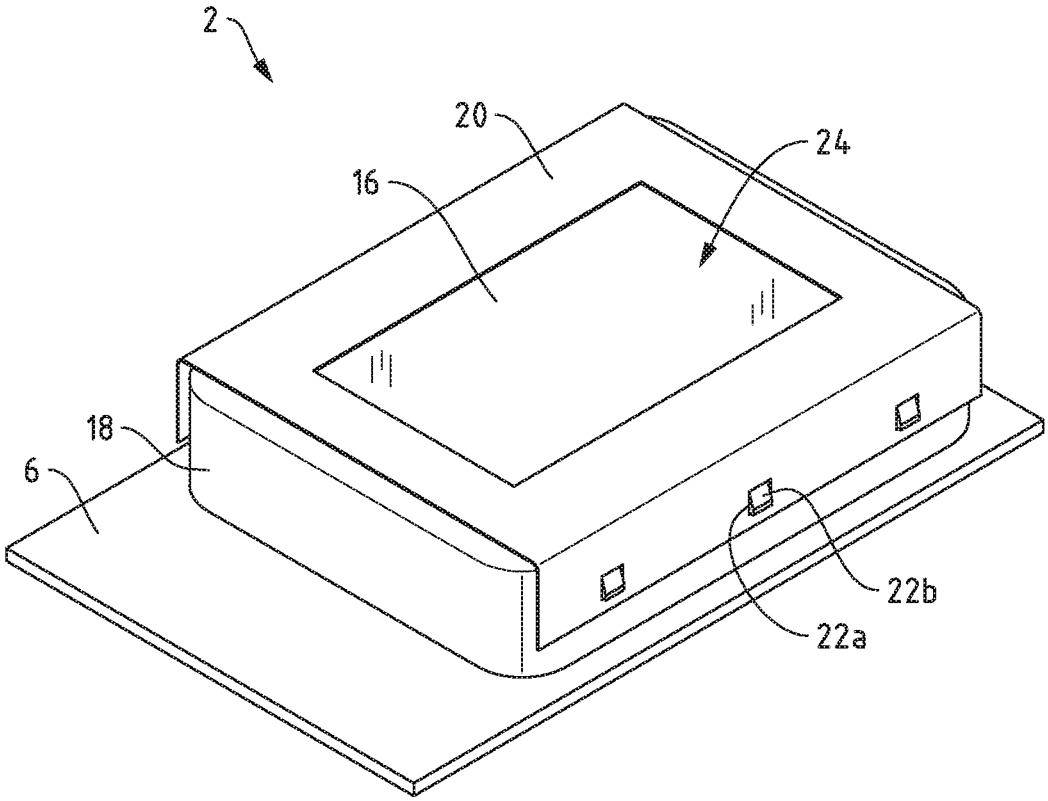
FIG. 1*b* schematically shows the embodiment of the lighting device according to the invention in a perspective view.

FIG. 1*a* schematically shows a lighting device 2 according to the invention in an exploded view. Correspondingly, FIG. 1*b* schematically shows the embodiment of the lighting device 2 according to the invention in a perspective view. The lighting device 2 comprises light-emitting elements 4 arranged on a substrate 6, which is configured as a printed circuit board. The light-emitting elements 4 are arranged in a 5×6 matrix on the substrate 6.

A lens 8 with a light entry side 10 and a light exit side 12 is provided, the lens 8 being configured as an integral element with an array of light guides 14. Each light guide 14 is configured for an optical contact to one of the light-emitting elements 4, wherein the light guides 14 form a matrix corresponding to the matrix of light-emitting elements 4. The light guides 14 are configured to guide light emitted by the corresponding light-emitting element 4, to which an optical contact is made, towards the light entry side 10 of the lens 8.

The light guides 14 are configured as collimators for the light emitted by the light-emitting elements 4. In particular, the light guides 14 consist of transparent silicone with sidewalls that are providing a collimation of light by total internal reflection.

Further, a transparent stabilizer element 16 is provided. The transparent stabilizer element 16 is arranged in mechanical contact to the light exit side 12 of the lens 8. When the lighting device 2 is assembled, the transparent stabilizer element 16 is configured to define the shape of the light exit side 12 of the lens 8 in a central region of the light exit side 12.

The lighting device 2 further comprises a holder 18 disposed on the substrate 6, the holder 18 being fixed to the substrate 6 by fixing means 19 such as screws. The holder 18 is configured to hold the transparent stabilizer element 16 relative to the light-emitting elements 4 in a direction substantially perpendicular to the surface normal of the substrate 6.

For this, a frame element 20 is provided, which can be mechanically fixed to the holder 18 by means of corresponding latching elements 22*a*, 22*b* arranged on the frame element 20 and the holder 18, respectively. The frame element 20 comprises an opening 24 in the area of the light-emitting elements 4 and the light guides 14, such that a blocking of light by the frame element 20 is reduced.

Figure 2A:
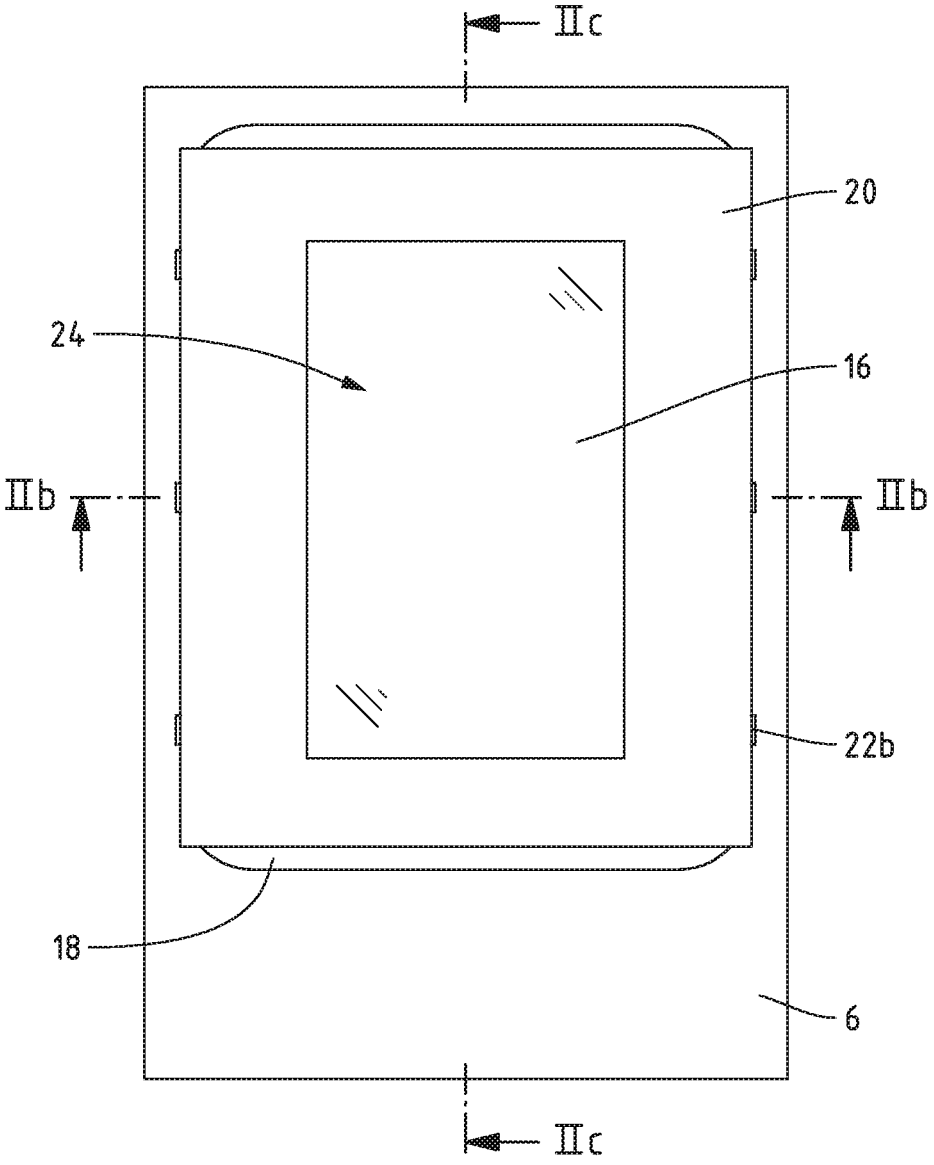
FIG. 2*a* schematically shows the embodiment of the lighting device according to the invention in a plan view.
Figure 2B:
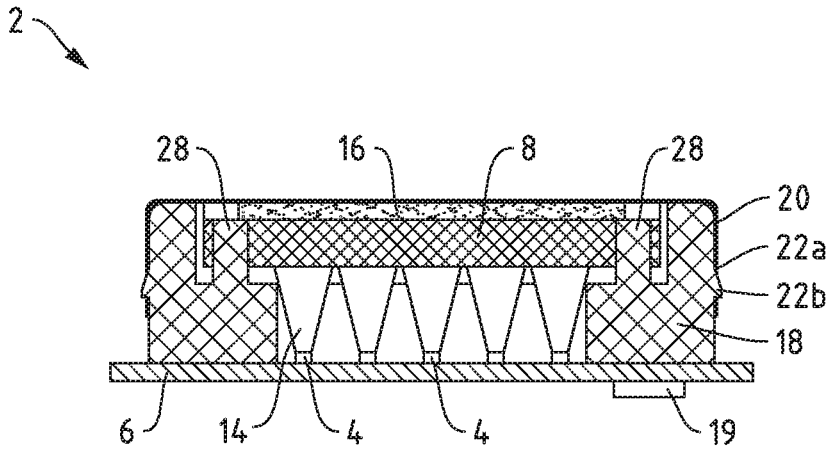
FIGS. 2*b*, 2*c* schematically show the embodiment of the lighting device according to the invention in sectional views.
Figure 2C:
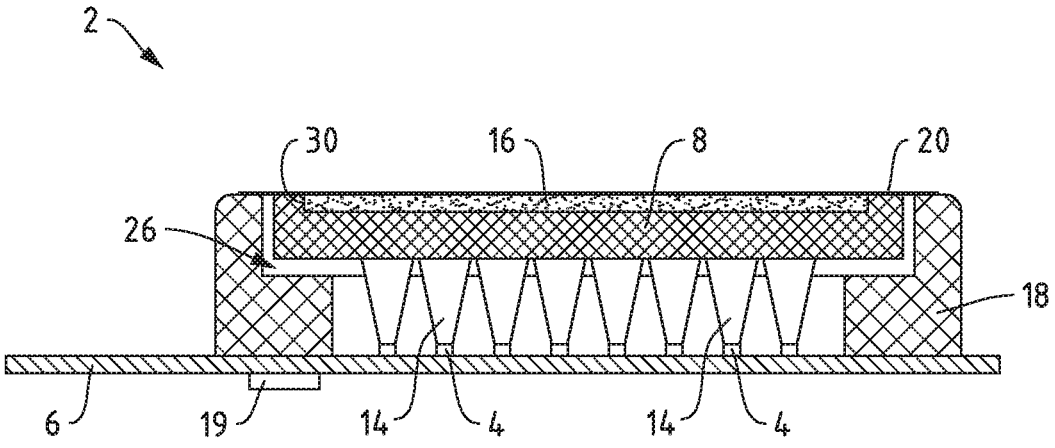

As is in particular apparent from FIGS. 2*b* and 2*c*, which show sectional views in the planes IIb and IIc of FIG. 2*a*, the holder 18 comprises a lens recess 26 for accommodating the lens 8. A gap is provided between the holder 18 and the lens 8 in the lens recess 26, both in directions parallel and perpendicular to a surface normal of the substrate 8.

During operation of the lighting device 2, the light-emitting elements 4 may create a high heat load. As the light-emitting elements 4 are arranged on the substrate 6 in an array and may be positioned close to each other, high temperature gradients may in addition occur as the center of the arrangement of light-emitting elements 4 is subject to a higher heat load than the edges of the arrangement.

The gap allows the lens 8 to expand in direction of the holder 18 when temperature changes occur during operation of the lighting device 2. As the transparent stabilizer element 16 is configured to define the shape of the light exit side 12 and is held by the holder 18 and the frame element 20 relative to the substrate 6, the thermal expansion of the lens 8 and the light guides 14 is effectively limited in the direction of the light exit side 12. In particular, the light exit side 12 of the lens 8 retains a planar shape due to the mechanical contact to the transparent stabilizer element 16. Hence, a bulging effect of the lens 8 and the light guides 14 (e.g. by an expansion of the lens 8 through the opening 24 of the frame element 20) may be avoided. The bulging effect has been found to be critical for thermal sensitivity, as the bulging causes a tilting of the light guides 14 relative to the light-emitting faces of the light-emitting elements 4 that drastically reduces the effectivity of light incoupling into the light guides 14 and the collimation by total internal reflection. With the inventive transparent stabilizer element 16, this effect may be reduced and the thermal sensitivity of the lighting device 2 is significantly improved.

The holder 18 also comprises lateral alignment elements 28 configured to hold the lens 8 relative to the light-emitting elements 4 in a direction substantially perpendicular to the surface normal of the substrate 6, further improving thermal stability of the lighting device 2. The lateral alignment elements 28 are positioned substantially in the center of edge regions of the holder 18. Specifically, the holder 18 comprises a substantially rectangular shape, wherein the lateral alignment elements 28 are positioned substantially in the center of a long side of the rectangular shape to reduce a displacement of the lens 8 relative to the holder 18 due to thermal expansion.

The lens 8 comprises a stabilizer recess 30 for accommodating the transparent stabilizer element 16 in a form fit. In this embodiment, the transparent stabilizer element 16 has a planar shape and consists of glass. The transparent stabilizer element 16 is in particular a rectangular glass sheet that provides sufficient mechanical stability to the lens 8 and light guides 14 while allowing for a high transmission of light emitted by the light-emitting elements 4.

In the stabilizer recess 30, the transparent stabilizer element 16 is positioned laterally and is in mechanical contact to the light exit side 12. Here, the transparent stabilizer element 16 is arranged in indirect mechanical contact to the light exit side of the lens via an optical index matching paste, which reduces undesired reflection effects at the interface of the transparent stabilizer element 16 and the lens 8. At the same time, differences in thermal expansion in a lateral direction are compensated.

Figure 3A:
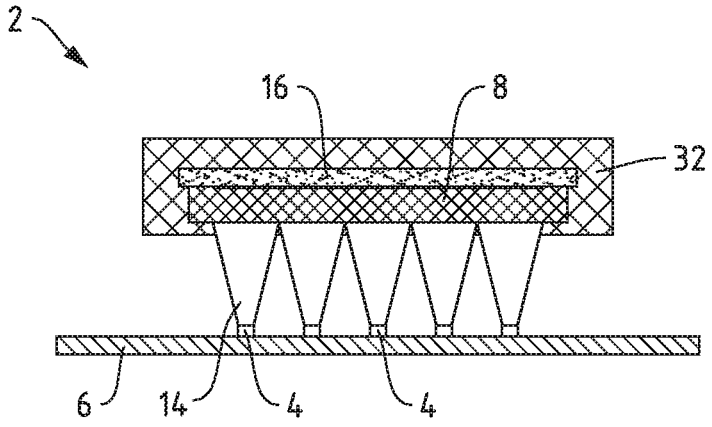
FIGS. 3*a*, 3*b* schematically show another embodiment of the lighting device according to the invention in sectional views.
Figure 3B:
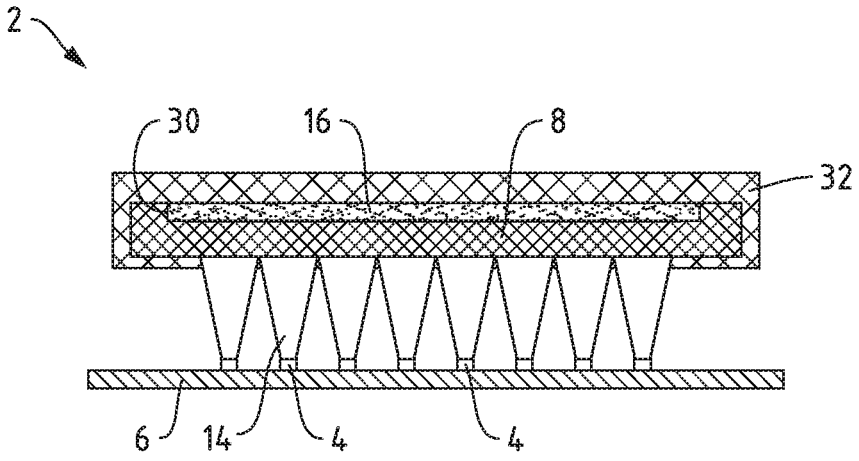

FIGS. 3*a*, 3*b* schematically show an alternative embodiment of the lighting device 2 according to the invention in sectional views analogous to those of FIGS. 2*b*, 2*c*. In this embodiment, the transparent stabilizer element 16 and the lens 8 are overmolded with a transparent covering material 32. Therefore, the frame element 20 may be omitted, allowing for a particularly simple and cost-effective production of the lighting device 2. In addition, the lighting device 2 according to this embodiment may also comprise a holder (not shown) that is in particular also overmolded by the transparent covering material 32.

The transparent covering material 32 may also comprise protrusions (not shown), in particular dome-shaped protrusions. Such protrusions may each correspond to a light guide 14.

Figure 4:
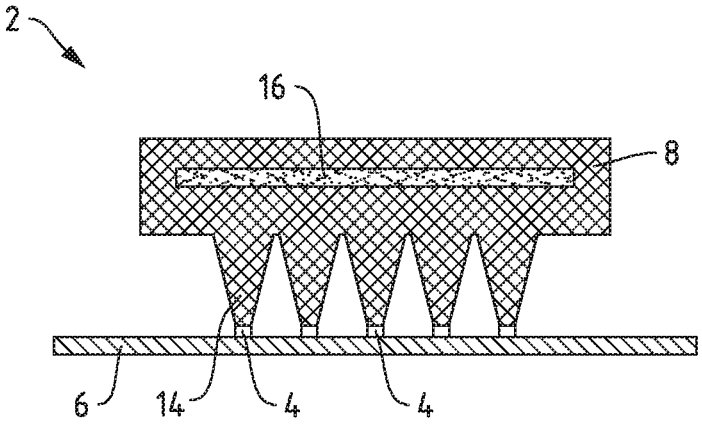
FIG. 4 schematically shows another embodiment of the lighting device according to the invention in a sectional view.

FIG. 4 schematically shows a further alternative embodiment of the lighting device 2 according to the invention in a sectional view analogous to the sectional views of FIGS. 2*b*, 2*c*. In this embodiment, the transparent stabilizer element 16 is embedded inside of lens 8. It is to be understood that the transparent stabilizer element 16 may fully or partially be embedded inside of lens 8, which may in both cases achieve a desirable enhancement of stability. Light guides 14 are formed integrally with lens 8, for example using transparent silicone. As the preceding embodiment of FIGS. 3*a* and 3*b*, also the embodiment of FIG. 4 may allow for a particularly simple and cost-effective production of the lighting device 2. For example, lens 8 and light guides 14 may be formed by molding a suitable lens material, e.g. transparent silicone, (at least partially) around the stabilizer element 16. Again, also in this embodiment, the frame element 20 may be omitted, which may further add to simplicity of the production process.

The invention claimed is:

1. A lighting device, comprising:

light-emitting elements arranged on a substrate;

a lens with a light entry side and a light exit side;

light guides, each light guide being arranged in optical contact to at least one of the light-emitting elements and being configured to guide light emitted by the at least one of the light-emitting elements towards the light entry side of the lens; and a transparent stabilizer element having a planar shape and being arranged in mechanical contact to the light exit side of the lens, wherein the transparent stabilizer element is configured to define the shape of the light exit side of the lens at least in regions.

2. The lighting device according to claim 1, wherein the transparent stabilizer element comprises or consists of glass.

3. The lighting device according to claim 1, further comprising a holder disposed on the substrate, wherein the holder is configured to hold the transparent stabilizer element relative to the light-emitting elements.

4. The lighting device according to claim 3, wherein the holder comprises a lens recess for accommodating the lens.

5. The lighting device according to claim 4, wherein a gap is provided at least in sections between the holder and the lens in the lens recess.

6. The lighting device according to claim 3, wherein the holder comprises at least one lateral alignment element configured to hold the lens relative to the light-emitting elements.

7. The lighting device according to claim 1, wherein the lens comprises a stabilizer recess for accommodating the transparent stabilizer element.

8. The lighting device according to claim 1, wherein both the transparent stabilizer element and the lens are overmolded with a transparent covering material.

9. The lighting device according to claim 1, wherein the transparent stabilizer element is fully embedded inside of the lens.

10. The lighting device according to claim 1, wherein the transparent stabilizer element is arranged in mechanical contact to the light exit side of the lens via a paste, in particular via an optical index matching paste.

11. The lighting device according to claim 1, wherein the light-emitting elements are arranged in a matrix on the substrate.

12. A method for producing a lighting device, the method comprising:

arranging light-emitting elements on a substrate;

providing light guides and a lens, the lens having a light entry side and a light exit side, wherein each light guide is arranged in optical contact to at least one of the light-emitting elements and is configured to guide light emitted by the at least one of the light-emitting elements towards the light entry side of the lens;

arranging a transparent stabilizer element having a planar shape in mechanical contact to the light exit side of the lens such that the transparent stabilizer element defines the shape of the light exit side of the lens at least in regions.

13. The method according to claim 12, further comprising overmolding both the transparent stabilizer element and the lens with a transparent covering material.

14. The method according to claim 12, wherein the light guides or the lens is provided by a molding process.

15. The method according to claim 12, further comprising: disposing a holder on the substrate, wherein the holder is configured to hold the transparent stabilizer element relative to the light-emitting elements, and wherein the holder is provided by a molding process.

16. The method according to claim 12, wherein the transparent stabilizer element is fully embedded inside of the lens.

* * * * *